United States Patent [19]

Imai et al.

[11] 4,151,496

[45] Apr. 24, 1979

[54] STEPPING RELAY HAVING A SINGLE MOUNTING MEMBER

[75] Inventors: Yoshikiyo Imai, Moriyama; Syunichi Agatahama, both of Nagaokakyo, Japan

[73] Assignee: Omron Tateisi Electronics Co., Kyoto, Japan

[21] Appl. No.: 853,910

[22] Filed: Nov. 22, 1977

[30] Foreign Application Priority Data

| | | | |
|---|---|---|---|
| Nov. 22, 1976 | [JP] | Japan | 51/156546[U] |
| Dec. 20, 1976 | [JP] | Japan | 51/171265[U] |
| Jun. 20, 1977 | [JP] | Japan | 52/81318[U] |

[51] Int. Cl.[2] ..... H01H 51/08

[52] U.S. Cl. ..... 335/140; 335/123

[58] Field of Search ..... 335/140, 139, 138, 123; 74/142

[56] References Cited

U.S. PATENT DOCUMENTS

| | | | |
|---|---|---|---|
| 3,106,849 | 10/1963 | Valleau | 74/142 |
| 3,168,629 | 2/1965 | Roberts et al. | 335/123 |
| 3,447,106 | 5/1969 | Jameel | 335/140 |

*Primary Examiner*—Harold Broome

*Attorney, Agent, or Firm*—Stevens, Davis, Miller & Mosher

[57] ABSTRACT

A stepping relay comprising a base member to which every other component is mounted. On one side of the base member, mounted are a printed circuit board, a slider, and a dust cover. On the other side of the base member, mounted are an electromagnet, a ratchet, a positioning switch, and an interrupting switch.

5 Claims, 5 Drawing Figures

STEPPING RELAY HAVING A SINGLE MOUNTING MEMBER

BRIEF SUMMARY OF INVENTION

This invention relates to a stepping relay of unique construction utilizing an electromagnet.

In prior art stepping relays, each component such as an electromagnet, a drive mechanism, and a contact assembly is connected to another by many screws or other fastening devices without having any common base to which each component is to be mounted. Therefore, prior art stepping relays using many fastening devices are complex, large, difficult to assemble, and expensive. Prior art stepping relays further have problems in accuracy of contacting pressure between a sliding member and stationary contacts, and in accuracy of stepping operation.

Accordingly, an object of the invention is to provide an improved stepping relay which is simple and compact in construction.

Another object of the invention is to provide an improved stepping relay of which stepping portion is made to be dust proof by covering.

An additional object of the invention is to provide a stepping relay which has a more stable stepping operation.

These and other advantages are obtained through a provision of a stepping relay having a base on one side of which mounted are a printed circuit board, a slider, and a dust cover, and on the other side of which mounted are an electromagnet, a ratchet, an interrupting switch, and a positioning switch.

In a particularly preferred form of the invention, a stopper is formed on the base to restrict the movement of a pawl of the ratchet.

The nature of the invention, including the foregoing and other object and novel features, will be more fully appreciated from the following detailed description when taken in conjunction with the accompanying drawings.

DESCRIPTION OF THE PREFERRED EMBODIMENT

Figure 1:
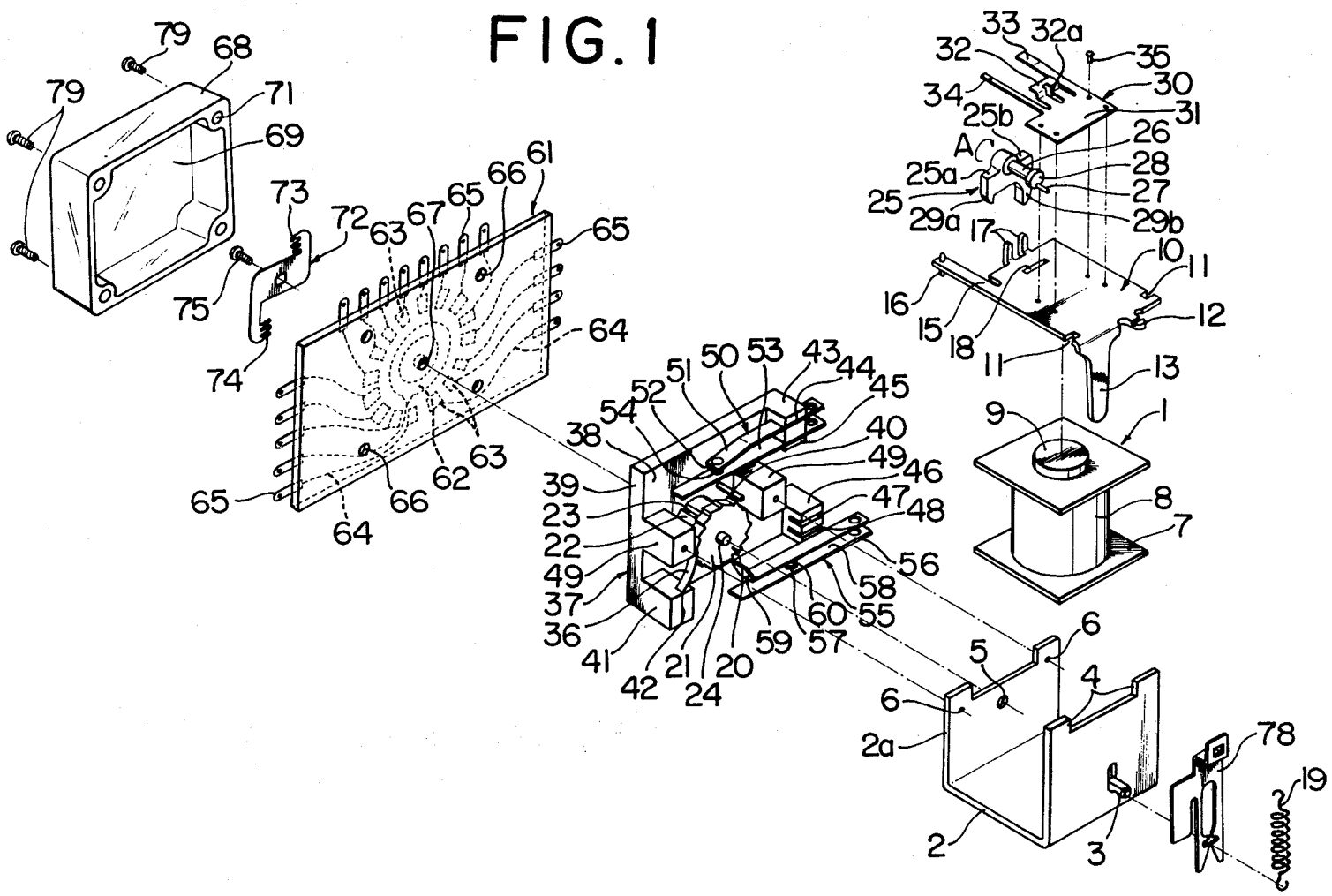
FIG. 1 is an exploded view of an improved stepping relay, constructed in accordance with the teachings of this invention.

Referring to the drawings and particularly to FIG. 1, a stepping relay embodying the present invention consists, as its major parts, of an electromagnet 1, a ratchet 20, a base 37 made of an insulating material such as a plastic, a printed circuit board (hereinafter PC board) 61, a dust cover 68, and a slider 72 being intermittently driven by the ratchet 20.

Figure 2:
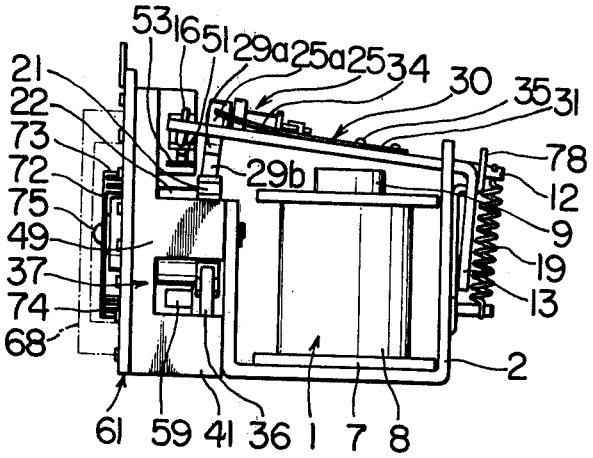
FIG. 2 is a front view of the stepping relay shown in FIG. 1.

The electromagnet 1 comprises a U-shaped yoke 2, a spool 7 on which a coil 8 is wound up, a core 9 which is calked to the yoke 2, an armature 10 pivotably mounted on one end of the yoke 2, and a coil spring 19 placed between a first jut 3 of the yoke 2 and a second jut 12 of the armature 10. The armature 10 is urged by the coil spring 19 in clockwise direction as shown in FIG. 2. The electromagnet 1 further comprises a spacer 78 placed between the yoke 2 and the coil spring 19. Said spacer 78 prevents the armature 10 from coming off from the yoke 2. The armature 10 has a first extention 13 which is bent downwardly and restricts the rotation of the armature 10 by pushing one side of the yoke 2 through the spacer 78 made of a nonmagnetic material.

The ratchet 20 comprises a ratchet wheel 21, a cam 22 having a groove 23, a main shaft 24 which can be molded in one body with the ratchet wheel 21 and the cam 22, a pawl 25 being rotatably attached to the armature 10, and a pawl 36 mounted on a first block 41 which is formed on a first side 38 of the base 37. The ratchet 20 is rotatably placed between the first side 38 of the base 37 and the yoke 2, the main shaft 24 being supported by a hole (not shown) formed on the base 37 and a hole 5 formed on the yoke 2.

The pawl 25 attached to the armature 10 is rotatable about a shaft portion 26 placed between a first set of projections 17, 17. A first elastic arm 33 and a second elastic arm 34 of a flat spring 30 which is screwed up on the armature 10 by screws 35, push downwardly a first shoulder 25*a* and a second shoulder 25*b* of the pawl 25 respectively, a spring force of the first elastic arm 33 being bigger than that of the second elastic arm 34. A crook 32 of the flat spring 30 holds a pin portion 27 of the pawl 25. A flange 28 of the click 25 is inserted into a slit 18 formed on the armature 10. When the pawl 25 is actuated by the armature 10, a first nail 29*b* of the pawl 25 pushes to rotate the ratchet wheel 21 clockwise. The rotational angle of the ratchet wheel 21 in each operation is controlled by a second nail 29*a* of the pawl 25. A reversal rotation of the ratchet wheel 21 is prevented by the pawl 36. The rotation of the pawl 25 urged by the flat spring 30 clockwise (shown by arrow A) is restricted by a rod stopper 40 which projects from the first side of the base 37 in order to avoid a overstepping of the pawl 25.

An interrupting switch 50 comprises a first stationary blade 51 having a first stationary contact 52, and a first movable blade 53 having a first movable contact 54, both blades being placed in a second groove 44 and a third groove 45 formed on a second block 43 respectively. The interrupting switch 50 is normally closed, and is opened, when the electromagnet 1 is energized, by a pin 16 which is made of a plastic material and is mounted on one end of a second extention 15 of the armature 10.

A positioning switch 55 comprises a second stationary blade 56 having a second stationary contact 57, and a second movable blade 58 having a second movable contact 60, both blades being placed in a fifth groove 48 and a forth groove 47 formed on a third block 46 respectively. A bend 59 which is coupled with the cam 22 is formed at one end of the second movable blade 58. The positioning switch 55 is normally closed, and is opened when the bend 59 drops in a groove 23 formed on the cam 22.

The interrupting switch 50, the positioning switch 55 and the electromagnet 1 are connected in series.

Figure 3:
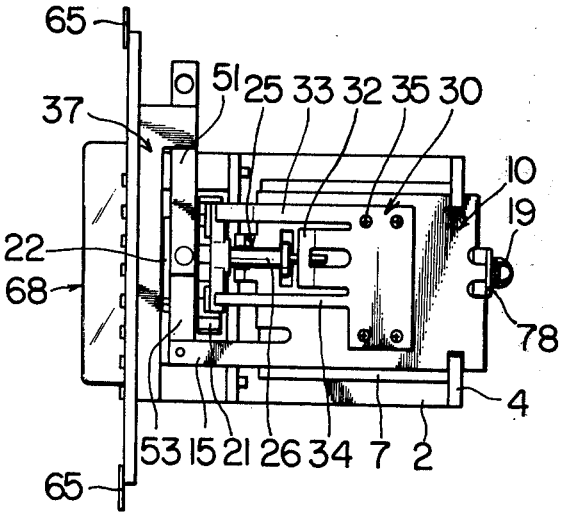
FIG. 3 is a top view of the stepping relay shown in FIG. 1.
Figure 4:
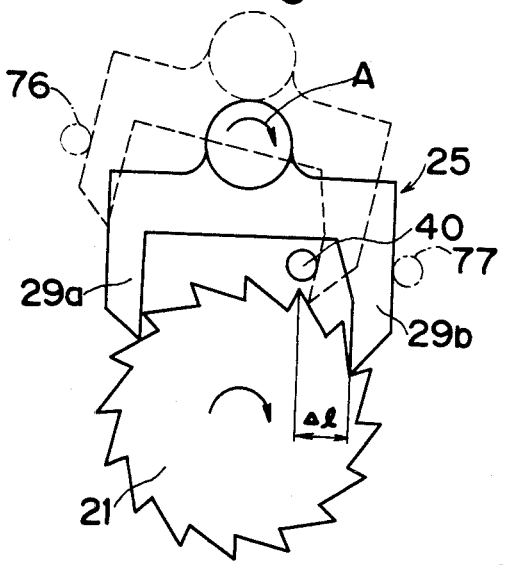
FIG. 4 is a schematic side view showing a ratchet and rod stoppers in the stepping relay shown in FIG. 1; and, FIG. 5 is a electric circuit of the stepping relay shown in FIG. 1

On the left side surface (FIG. 2, FIG. 3) of the PC board 61 attached to a second side 39 of the base 37, printed are a ring shaped common contact 62, and a set of circular contacts 63 which form a circle outside said common contact 62, said common contact 62 and said set of circular contacts 63 being coaxial with the ratchet 20. The second side 39 is in the back of the first side 38. The circular contacts 63 are printed at a pitch corresponding to the pitch of the ratchet wheel 21. Each circular contacts 63 is connected to a respective terminal 65 printed or calked on the edge of the PC board 61 by a respective lead line 64 which is also printed on the PC board 61.

A dust cover 68 is attached to the left side of the PC board 61 (FIG. 2, FIG. 3) for covering the common contact 62 and the circular contacts 63. Screws 79 screw up both the dust cover 68 and the PC board 61 to the base 37.

The slider 72 made of an electric conductor has a first sliding contact 73, and a second sliding contact 74, said first sliding contact 73 being in contact with the common contact 62, and said second sliding contact 74 being in contact with one of the circular contacts 63. The slider 72 is attached by a screw 75 to the main shaft 24 which protrudes from a center hole 67 of the PC board 61, and placed in a hollow 69 of the dust cover 68; that is, the slider 72 is located between the PC board 61 and the dust cover 68.

A stepping relay comprising above-mentioned components can be covered except the dust cover 68 and the PC board 61 by a case (not shown).

The operation of the stepping relay of the present invention is as follows.

As a normal position, the armature 10 of the electromagnet 1 is in snapped-up position as shown in FIG. 2, and the second sliding contact 74 is in contact with one of the circular contacts 63. Both the interrupting switch 50 and the positioning switch 55 are closed except that the positioning switch 55 is opened when the ratchet 20 and, subsequently, the slider 72 are at a certain predetermined position (hereinafter zero position).

Figure 5:
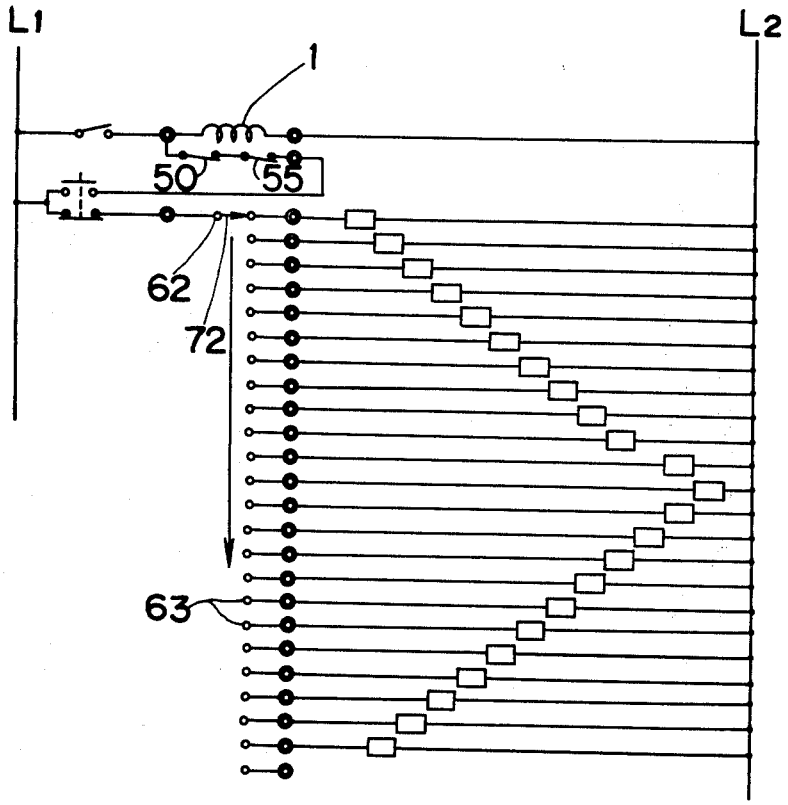

When an input signal is given to the electromagnet 1 as shown in FIG. 5, the pawl 25 which is rotatably mounted on the armature 10 pushes down the ratchet wheel 21 to rotate clockwise by a pitch. The slider 72 is also rotated clockwise, therefore, the second sliding contact 74 steps from the former circular contact to the neighboring circular contact.

When the electromagnet 1 is deenergized, the pawl 25 and the armature 10 return to the normal position without rotating the ratchet 20 and the slider 72.

When quick returning a zero position is required, the power to energize the electromagnet 1 is supplied through the interrupting switch 50 and the positioning switch 55 as shown in FIG. 5. The interrupting switch 50 is normally closed and is opened, when the electromagnet 1 is energized, by the pin 16 which pushes the first movable blade 53 downwardly. Because the power to the electromagnet 1 is chopped by the interrupting switch 50 in the aforementioned manner, the ratchet 20 is repeatedly rotated until it comes to zero position. When the ratchet 20 comes to zero position, the bend 59 of the second movable blade 58 drops in the groove 23 formed on the cam 22, and the positioning switch 55 is opened. Thus the power to the electromagnet 1 is turned off, and the slider 72 staying at zero position is ready to receive next input signal.

According to the present invention, the stepping relay is simple and compact in the construction and easy to assemble which is reduced to the exactness of the operation; in other words, a misstep and an overstep are avoided. Furthermore, the common contact 62, the circular contacts 63, and the slider 72 which are covered and protected by the dust cover 68 are proof against dust.

While a specific embodiment of the invention has been shown and described in detail to illustrate the application of the inventive principle, it is to be understood that the invention may be embodied otherwise without departing from such principles.

What is claimed is:

1. A stepping relay comprising:

a base made of an insulator;

an electromagnet having a U-shaped yoke, and being mounted on a first side of said base;

a pawl rotatably mounted on an armature of said electromagnet, and being located on said first side of said base;

a ratchet rotatably supported by and between said base and said U-shaped yoke, and being actuated by said pawl when said electromagnet is energized, and being located on said first side of said base;

a printed circuit board on which a common contact and circular contacts are printed, said printed circuit board being mounted on a second side of said base, said second side being in the back of said first side; and, a slider mounted on a main shaft of said ratchet, and having a first and a second sliding contacts which are rotationally slidable on said common contact and said circular contacts respectively, and being located on said second side of said base.

2. A stepping relay as in claim 1, wherein a stopper is further provided for avoiding a misstep and a overstep of said pawl.

3. A stepping relay as in claim 1, wherein an interrupting switch which is normally closed and is opened when said electromagnet is energized, and a positioning switch which is normally closed and is opened when said ratchet comes to a predetermined position are further provided, said interrupting switch and said positioning switch being in series connection with said electromagnet.

4. A stepping relay as in claim 3, wherein said base is further provided with blocks on said first side of said base for mounting said interrupting switch and said positioning switch.

5. A stepping relay as in claim 1, wherein a dust cover is further provided for covering said common contact, said circular contacts, and said slider.

* * * * *